US006302307B1

(12) United States Patent
Hirsch et al.

(10) Patent No.: US 6,302,307 B1
(45) Date of Patent: Oct. 16, 2001

(54) COFFEE SYSTEM WITH SELF-SEALING COFFEE POT

(76) Inventors: Daniel J. Hirsch; Nancy Wagner, both of 527 N. Sheridan Rd., Waukegan, IL (US) 60085

( * ) Notice: Subject to any disclaimer, the term of this patent is extended or adjusted under 35 U.S.C. 154(b) by 0 days.

(21) Appl. No.: 09/611,287

(22) Filed: Jul. 6, 2000

Related U.S. Application Data

(63) Continuation-in-part of application No. 09/320,616, filed on May 26, 1999, now Pat. No. 6,085,946.

(51) Int. Cl.[7] ..... B65D 5/72

(52) U.S. Cl. ..... 222/500; 222/475.1; 219/297; 99/279

(58) Field of Search ..... 222/475.1, 500; 99/279, 250; 219/297

(56) References Cited

U.S. PATENT DOCUMENTS

| | | | | |
|---|---|---|---|---|
| 102,124 | | 4/1870 | Hobbs | 222/500 |
| 134,586 | | 1/1873 | Bradley | 222/500 |
| 1,143,656 | | 6/1915 | Spahr | 222/500 |
| 3,168,226 | | 2/1965 | Underwood et al. | 222/500 |
| 3,974,758 | | 8/1976 | Stone, Jr. | 99/275 |
| 4,261,487 | | 4/1981 | Seager | 222/520 |
| 4,361,257 | | 11/1982 | Stone, Jr. | 222/464 |
| 4,390,108 | | 6/1983 | Knoll | 220/228 |
| 4,478,139 | * | 10/1984 | Zimmerman | 99/280 |
| 4,482,083 | | 11/1984 | Beck | 222/500 |
| 4,638,929 | | 1/1987 | Stone, Jr. | 222/456 |
| 4,714,180 | | 12/1987 | Stone, Jr. | 222/456 |
| 4,715,269 | * | 12/1987 | Stoner | 99/279 |
| 4,867,349 | | 9/1989 | Stone, Jr. | 222/188 |
| 4,917,005 | * | 4/1990 | Knepler | 99/279 |
| 4,920,868 | * | 5/1990 | Gehrmann | 99/279 |
| 5,050,780 | | 9/1991 | Stone | 222/188 |
| 5,137,168 | * | 8/1992 | Mothrath et al. | 222/500 |
| 5,224,634 | | 7/1993 | Graham | 222/475.1 |
| 6,085,946 | | 7/2000 | Hirsch et al. | 222/475.1 |

* cited by examiner

*Primary Examiner*—Philippe Derakshani
*Assistant Examiner*—Thach H. Bui
(74) *Attorney, Agent, or Firm*—Marshall, Gerstein & Borun

(57) ABSTRACT

A coffee pot heating unit is provided with a base, a heating area associated with the base and having a size sufficient to accommodate a bottom portion of a coffee container, and a heating apparatus associated with the heating area to heat the heating area. The heating apparatus may include a heating element, and the heating apparatus may have an electrical resistance such that the heating apparatus generates no greater than about 80 watts of electrical power when the heating apparatus is connected to a 120-volt electrical power source. The heating apparatus generates a substantially fixed and constant electrical power output that does not change substantially while the heating apparatus is connected to the 120-volt power source.

43 Claims, 4 Drawing Sheets

COFFEE SYSTEM WITH SELF-SEALING COFFEE POT

This is a continuation-in-part of U.S. Ser. No. 09/320,616 filed May 26, 1999, now U.S. Pat. No. 6,085,946, which is incorporated by reference herein in its entirety.

BACKGROUND OF THE INVENTION

The present invention is directed to a coffee system having a self-sealing coffee pot and a heating system.

A conventional coffee pot heating unit may include a pair of heating areas, such as warming plates, a heating coil associated with each heating area, and a brewing system associated with one or both of the heating areas. Each heating coil in such a conventional coffee pot heating unit is typically rated to generate 100 watts of electrical power. To generate such a power output when the heating unit is connected to a typical 120-volt AC power outlet, each heating coil is made to have an electrical resistance of about 140 ohms. Since a typical commercial coffee pot holds about 64 fluid ounces of coffee, such a conventional heating unit generates a power output of about 1.5 watts per fluid ounce of the coffee-holding capacity of the coffee pot.

U.S. Pat. No. 4,715,269 to Stoner discloses a coffee maker that is designed to be used with a plastic coffee pot and a low temperature warming plate.

SUMMARY OF THE INVENTION

In one aspect, the invention is directed to a coffee pot heating unit having a base, a heating area associated with the base and having a size sufficient to accommodate a bottom portion of a coffee container, and a heating apparatus associated with the heating area to heat the heating area. The heating apparatus may include a heating element, and the heating apparatus may have an electrical resistance such that the heating apparatus generates no greater than about 80 watts of electrical power when the heating apparatus is connected to a 120-volt electrical power source. The heating apparatus generates a substantially fixed and constant electrical power output that does not change substantially while the heating apparatus is connected to the 120-volt power source.

The heating unit may also be provided with a switch that selectively interrupts current flow through the heating apparatus so as to allow the heating apparatus to be turned on and off. The heating apparatus has an electrical resistance of no less than about 180 ohms, or alternatively no less than about 290 ohms. The heating apparatus may have an electrical resistance such that the heating apparatus generates no greater than about 50 watts of electrical power when the heating apparatus is connected to a 120-volt electrical power source. The heating apparatus may generate no greater than about 1.25 watts of electrical power for each fluid ounce of the coffee-holding capacity of the coffee container when the heating apparatus is connected to a 120-volt electrical power source.

In another aspect, the invention is directed to a coffee system having a coffee pot and a coffee pot heating unit for heating the coffee pot. The coffee pot heating unit may include a base, a heating area associated with the base and having a size sufficient to accommodate a bottom portion of the coffee container, and a heating apparatus that has an electrical resistance such that the heating apparatus generates no greater than about 80 watts of electrical power when the heating apparatus is connected to a 120-volt electrical power source. The coffee pot may be disposed on the heating area of the coffee pot heating unit and may include a coffee container composed of glass and a pouring spout associated with the coffee container.

The features and advantages of the present invention will be apparent to those of ordinary skill in the art in view of the detailed description of the preferred embodiment, which is made with reference to the drawings, a brief description of which is provided below.

DETAILED DESCRIPTION OF VARIOUS EMBODIMENTS

Figure 1:
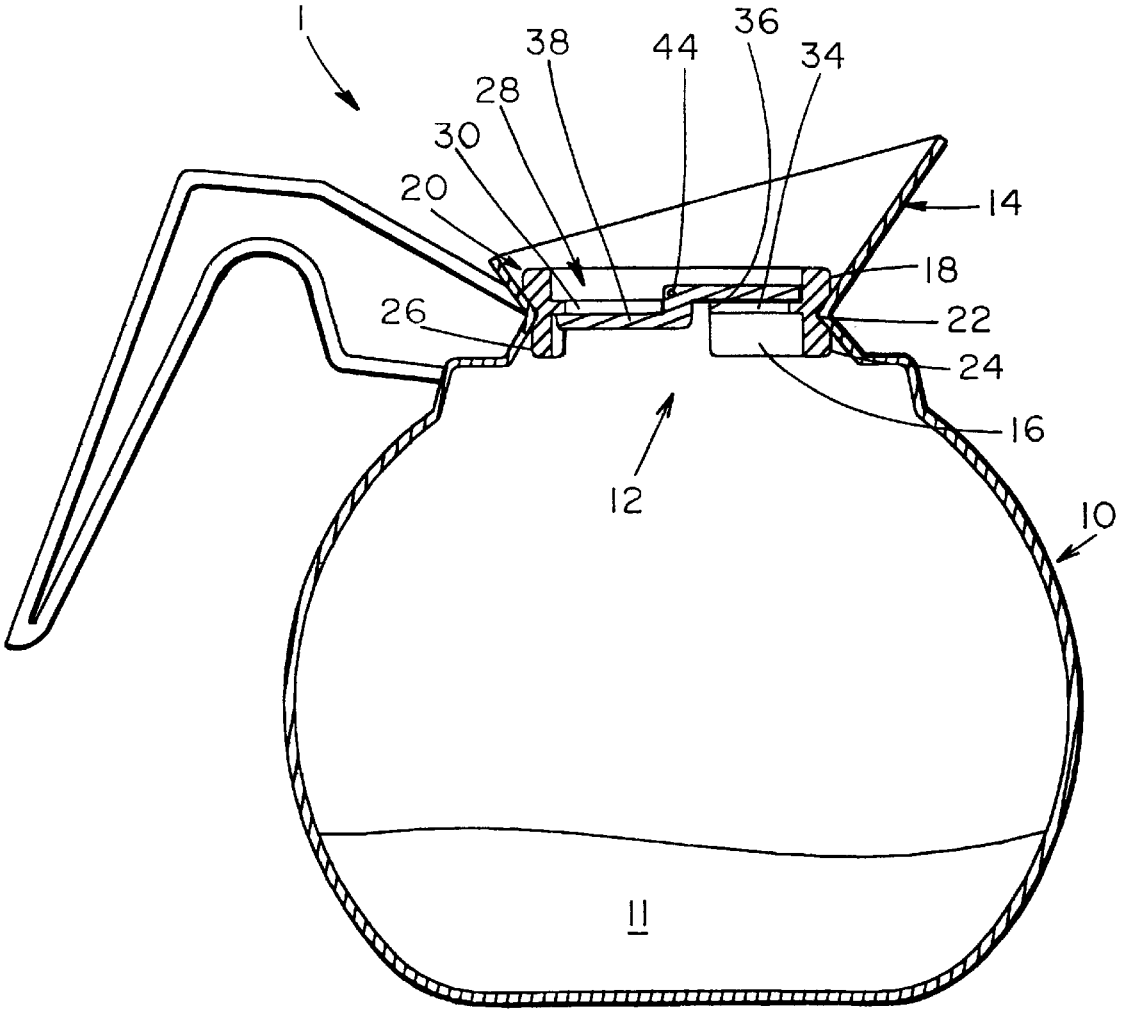
FIG. 1 is a cross-sectional side view of a preferred embodiment of a self-sealing coffee pot in accordance with the invention with a pivoting cap shown in a closed position.
Figure 2:
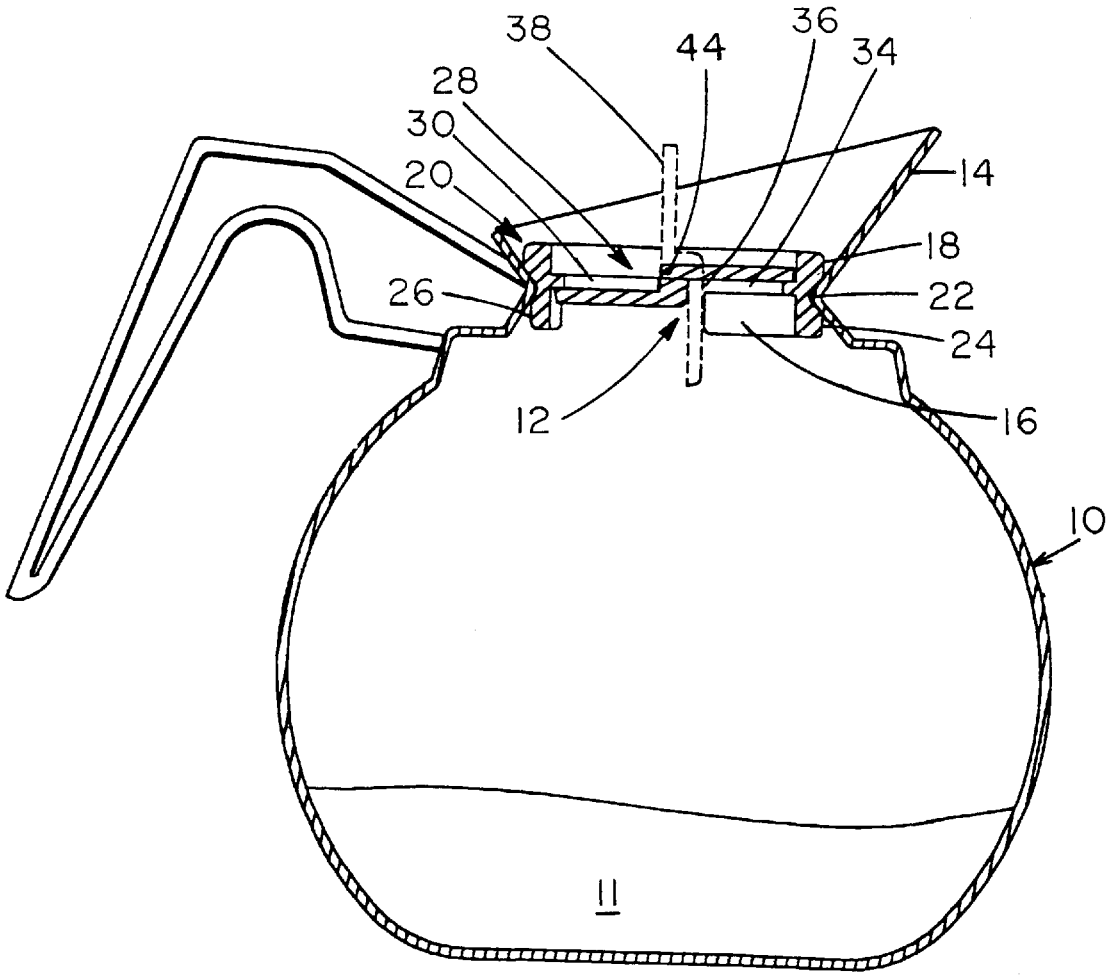
FIG. 2 is a cross-sectional side view of the coffee pot of FIG. 1 with the pivoting cap also shown in an open position.

FIGS. 1 and 2 illustrate an embodiment of a self-sealing coffee pot 1. Referring to FIGS. 1 and 2, the coffee pot 1 has a coffee container 10, comprising a continuous surface enclosing a volume containing liquid coffee 11. The coffee container 10 has an upward-opening mouth 12 for the pouring of liquid coffee into and out of coffee container 10. The mouth 12 may be formed with a pouring spout 14 so that when pouring coffee from the coffee container 10 the flow of the coffee may be controlled by tipping the coffee container from the upright position to allow the coffee therein to flow through the mouth 12 and through the pouring spout 14. The mouth 12 and pouring spout 14 may be formed of a continuous piece with the coffee container 10 or may be separate pieces joined to the coffee container 10.

A toroidally-shaped cover 16 is disposed in the mouth 12. The cover 16 has a cover outer surface 18. The cover outer surface 18 shape may not be cylindrical in shape; however, the cover outer surface 18 conforms to the shape of the mouth 12 to provide a close seal between the mouth 12 and the cover 16. The cover surface 16 is disposed above, adjacent to, and below the mouth 12. The upper portion of the cover outer surface 18 disposed above the mouth 12 extends radially beyond the mouth 12 comprises a flange 20. The flange 20 has a greater outer dimension to prevent the cover 16 from passing downward through the mouth 12. Below the flange 20, the cover outer surface 18 outer diameter decreases to form a groove 22 extending the entire circumference of the cover 16. The groove 22 is disposed vertically adjacent to the narrowest portion of the mouth 12. Below the groove 22 at the front of the cover 16 adjacent to the pouring spout 14, the cover outer surface 18 increases radially to a size larger than the mouth 12, comprising a skirt 24. The skirt 24 is disposed to extend for approximately the entire front half of the mouth 12 adjacent to the pouring spout 14. The sides of the skirt 24 disposed adjacent to the sides of the mouth 12 may be cut away to permit the skirt 24 to pass through the mouth 12 as the cover 16 is placed in mouth 12 during installation in the mouth 12. Below the groove 22 at the back of the cover 16, a retention arm 26 is disposed adjacent to the back of the mouth 12 comprised of a vertically-downward extension of the cover outer surface 18 below mouth 12. The outer surface of the retention arm 26 extends radially beyond the mouth 12. The retention arm 26 is disposed to extend for some portion of the back half of the mouth 12. In its normal position, the retention arm 26 contacts the back of the mouth 12 in opposition to contact made by the skirt 24 to secure the cover 16 in place in the mouth 12. The extent and the outer diameter of the retention arm 26 may be changed to permit secure retention of the cover 16 in the mouth 12 without interfering with the ability to remove the cover 16 from the mouth 12.

The cover 16 may be provided with a generally circular opening 28 disposed in the center of the cover 16. The cover opening 28 may comprise the only passage for liquid coffee and any other liquid or gas to pass through the cover 16 and into or out of the coffee container 10. Alternatively, more than one cover opening may be provided.

The cover 16 is fitted with a semi-circular back shoulder 30 projecting radially inward from the edge of cover 16 into the cover opening 28 towards the cover opening 28 center. Back shoulder 30 extends around the interior of the cover 16 for slightly less than one half of the inner circumference of the cover opening 28 such that there are two back shoulder ends 32 to the back shoulder 30. The back shoulder ends 32 are disposed a distance of approximately one half the thickness of the pivot member 38 from the side-to-side centerline of the cover 16 such that the back shoulder ends 32 are located within the semicircle formed by the back of the cover 16 and the cover side-to-side centerline. Back shoulder 30 is disposed away from the pouring spout 14. Back shoulder 30 top surface may be at any point below the top edge of the cover opening 28.

A semi-circular front shoulder 34 projecting radially inward from the cover 16 into the cover opening 28 may be disposed for slightly less than one half the inner circumference of the cover opening 28. Front shoulder 34 is disposed adjacent to the pouring spout 14. Front shoulder 34 top surface is disposed at the same distance below top surface of the cover opening 28 as back shoulder 30 top surface. A pair of front shoulder ends 36 may be disposed a distance of approximately the thickness of a pivot member 38 from the side-to-side centerline of the cover 16 such that the front shoulder ends 36 are located in the semicircle formed by the pouring spout 14 and the cover 16 side-to-side centerline.

The pivot member 38 may be provided in the form of a plate (such as a Z-shaped plate) disposed over the cover opening 28 so as to close the cover opening 28 to prevent the free passage of coffee and coffee vapors from the coffee container 10 when the coffee container 10 is in an upright orientation.

The front half of the pivot member 38 upper surface may have a convex shape to prevent the accumulation of liquid coffee on its upper surface during coffee dispensing. The bottom surface of the pivot member 38 front half may have a portion of its outer extremity configured to engage the cover 16 front shoulder 34 to promote the formation of a seal between the upper surface of the pivot member 38 front half. The outer extremity may be configured to prevent the pivot member 38 from adhering to the front shoulder 34 by the action of surface tension of coffee or condensed coffee on the front shoulder 34 and the pivot member 38 front half lower surface.

The back half of the pivot member 38 may feature a concave shape to collect coffee on its upper surface. In another embodiment, the back half of the pivot member 38 may be disposed below the front half of the pivot member 38, with the front half and back half being joined by a vertical extension of the pivot member 38 halves. The top surface of the pivot member 38 back half may have a portion of its outer extremity configured to engage the cover 16 back shoulder 30 to promote the formation of a seal between the upper surface of the pivot member 38 back half. The outer extremity may be configured to prevent the pivot member 38 from adhering to the back shoulder 30 by the action of surface tension of coffee or condensed coffee on the back shoulder 30 and the pivot member 38 back half upper surface. The coffee pot 1 may have a single or multiple raised contact points on the pivot member 38 contacting surfaces to reduce the adhesive forces created by the surface tension caused by the wetting of the pivot member 38 and the front shoulder 34 and the back shoulder 30. The contact points may be disposed onto the surfaces of the front shoulder 34 and back shoulder 30.

The pivot member 38 is pivotably supported by a support mechanism 44. The pivot member 38 is free to move pivotably from a closed position to an open position. In the closed position, the pivot member 38 is disposed in the horizontal plane with the front lower surface of pivot member 38 in contact or close proximity to the upper surface of the front shoulder 34 and the back upper surface of pivot member 38 in contact or close proximity to the lower surface of back shoulder 30. In the closed position, the pivot member 38 front half contacts the front shoulder 34 and the pivot member 38 back half contacts the back shoulder 30. In the closed position, the pivot member 38 provides a physical barrier across the cover opening 28 to prevent the release of evaporated coffee vapors from the coffee container 10. In the open position, the pivot member 38 may be pivoted to a nearly vertical position. In the open position, the pivot member 38 is disposed so that the cover opening 28 is open to permit the entrance or pouring out of coffee. In the open position, the front half of the pivot member 38 is rotated upward, away from the front shoulder 34 and the rear half of the pivot member 38 is rotated downward, away from the back shoulder 30.

Figure 3:
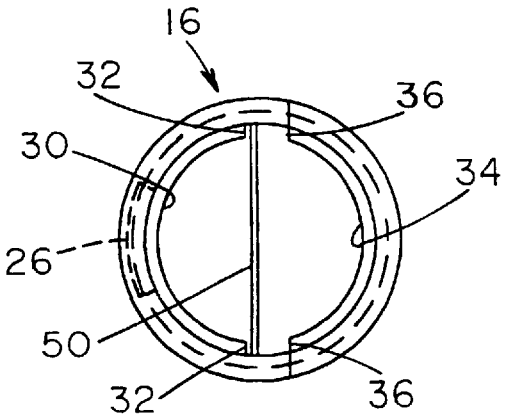
FIG. 3 is a top view of portions of the coffee pot, with other portions not shown for sake of clarity.

The support mechanism 44 is disposed at the two sides of the cover 16 so that the pivot member 38 is free to rotate about the centerline of the support mechanism 44. The support mechanism 44 may comprise a single rod element 50 (FIG. 3) disposed collinearly through the pivot member 38 and the two sides of the cover 16. The rod 50 may be free to rotate relative to the cover 16 or the pivot member 38 so that the pivot member 38 is free to move pivotably relative to the cover 16.

The support mechanism 44 may comprise two individual rod elements disposed collinearly across the two sides of the pivot member 38 such that their centerlines lie collinearly. The support mechanism 44 may comprise two rod elements projecting from the two edges of the pivot member 38. The rod elements may engage holes in the sides of the cover 16. In another embodiment, the support mechanism 44 may comprise two individual rod elements projecting radially from the sides of the cover 16 in a collinear disposition. The rods may engage either round holes or circular fittings on the pivot member 38.

The support mechanism 44 is disposed so that the pivot member 38 may move pivotably about the side-to-side centerline of the cover 16 from the closed position 46 to the open position 48. The disposition of the support mechanism 44 may be such that the pivot member 38 center of gravity is horizontally biased towards the front of the cover 16 and the pivot point about which the pivot member 38 pivots is horizontally biased towards the back of the cover 16. This configuration will hold the pivot member 38 in the closed position 46 when the coffee pot 1 is in the upright position. The disposition of the support mechanism 44 may be such that the pivot member 38 center of gravity is vertically disposed below the pivot point about which the pivot member 38 pivots. This configuration will tend to maintain the pivot member 38 in a horizontal attitude, thereby causing the pivot member 38 to move into the open position 48 when the coffee pot is rotated from the upright position for the pouring of coffee.

The support mechanism 44 may be vertically disposed so that the pivot member 38 does not come into full contact with the front shoulder 34 and back shoulder 30 in the closed position 46. This would reduce the adhesive forces caused by the surface tension between the wetted shoulders and pivot member 38 surfaces.

Operation of Coffee Pot

The movement of the pivot member 38 is intended to be automatic, without the necessity of user action, with only the hydrodynamic forces of flowing coffee and the static force of gravity significantly affecting the action of the pivot member 38.

The cover 16 is intended to remain installed in the mouth 12. Installation requires first inserting the skirt 24 into the mouth 12 adjacent to the pouring spout 14, then rotating about the cover's 16 horizontal axis and pressing down on the back half of the cover 16 until the groove 22 is seated in close proximity to the narrowest portion of the mouth 12. The force acting on the retention arm 26 through the mouth 12 causes the retention arm 26 to slightly, elastically deflect inward so that the groove 22 is positioned adjacent to the mouth 12. The elastic deformation of the retention arm 26 maintains the cover 16 in close contact with the mouth 12, securing it in position.

When the coffee pot 1 is in the upright orientation, gravity holds the pivot member 38 in the closed position 46, as the pivot member 38 is supported by the support mechanism 44 and the front shoulder 34.

When coffee is dispensed into the coffee container 10, if the coffee stream does not impinge on the back half of the pivot member 38 and force it into the open position 48 by hydrodynamic force, then a slight amount of coffee accumulates on the top surface of the pivot member 38. As the back half of the pivot member 38 is either concave or lower than the font half of the pivot member 38, more coffee weight is disposed on the pivot member's 38 back half causing the member 38 to rotate into the open position. Once open, the flow of coffee will hold the pivot member 38 in the open position. When the flow of coffee stops, the force of gravity acting on the pivot member 38 will cause the pivot member 38 to return to the closed position thereby sealing the coffee container.

When the coffee pot 1 is in the upright position for heating, the pivot member 38 will be held in the closed position 46 by the gravitational forces acting on it. Should the increased temperature within the pot cause an increase in internal pressure, the pivot member 38 will open momentarily, thus avoiding any undesirable pressure buildup within the coffee container 10.

To pour coffee from the coffee pot 1, the coffee container 10 is rotated from the upright orientation, which rotation will transpose the pivot member's 38 center of gravity and the location of the support mechanism 44. When this occurs, the force of gravity will rotate the pivot member 38 into the open position 48. Should the pivot member 38 tend to close as the pot is rotated back to a more upright orientation as the individual pouring coffee reduces flow at the end of the pouring sequence, the hydrodynamic pressure of the coffee flow through the cover opening 28, out of the pouring spout 14 will tend to hold the pivot member 38 in the open position 48. When returned to the upright position, the pivot member 38 will again be moved to the closed position 46 by the forces of gravity.

Coffee System

Figure 4:
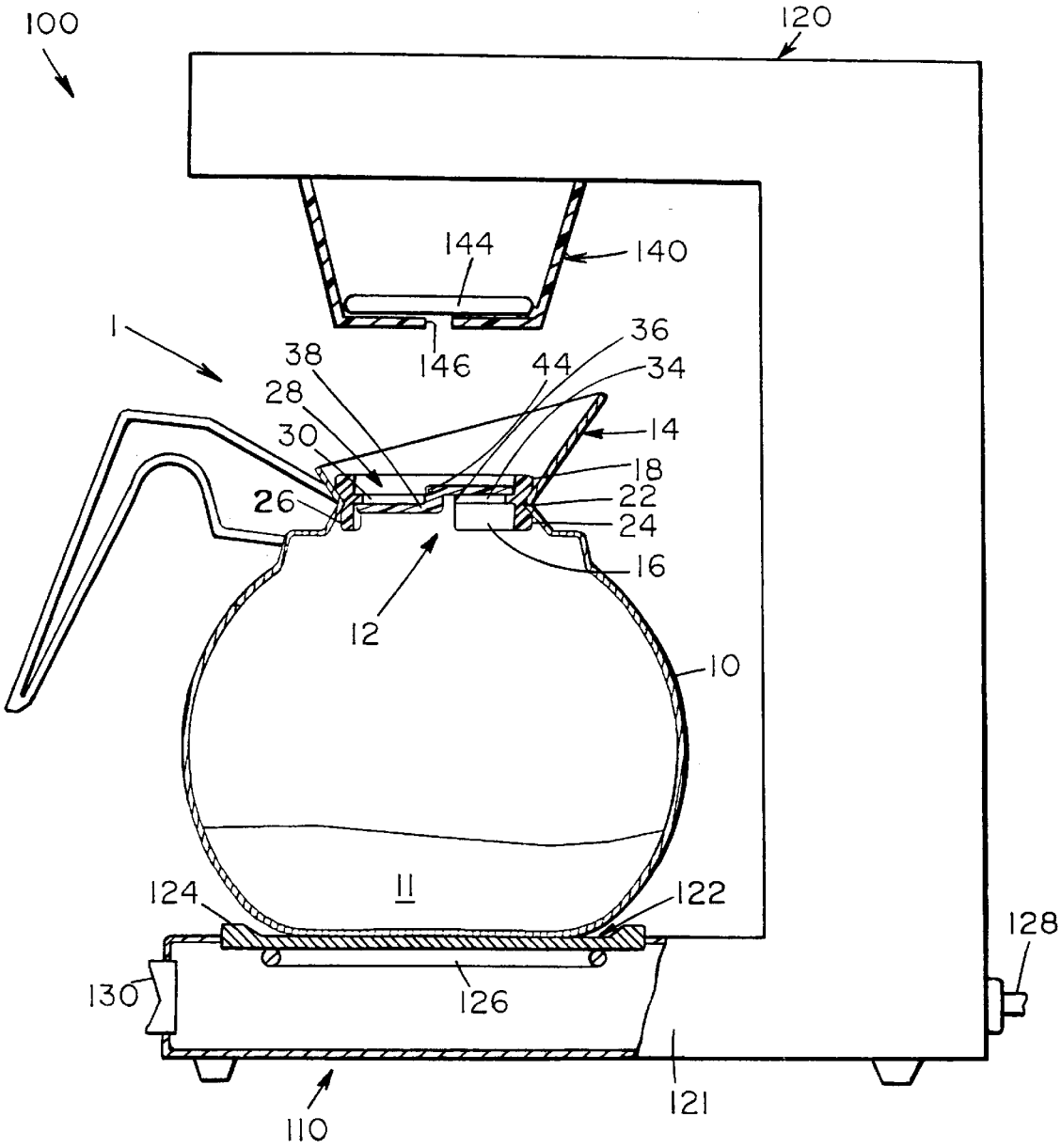
FIG. 4 is a side view of an embodiment of a coffee system in accordance with the invention with portions shown in cross section.
Figure 5:
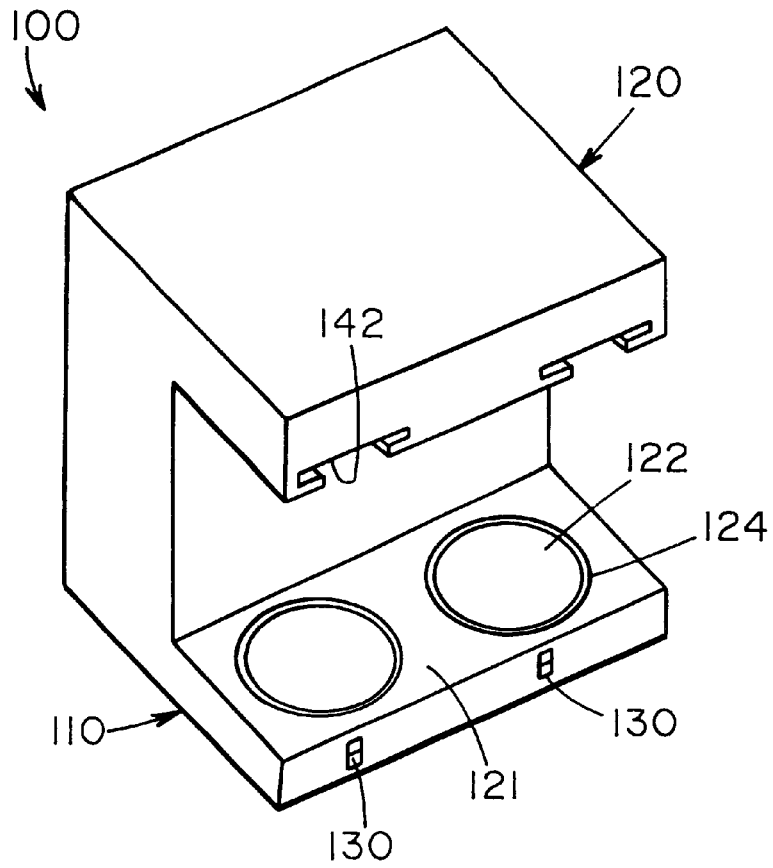
FIG. 5 is a perspective view of the coffee system of FIG. 4.
Figure 6:
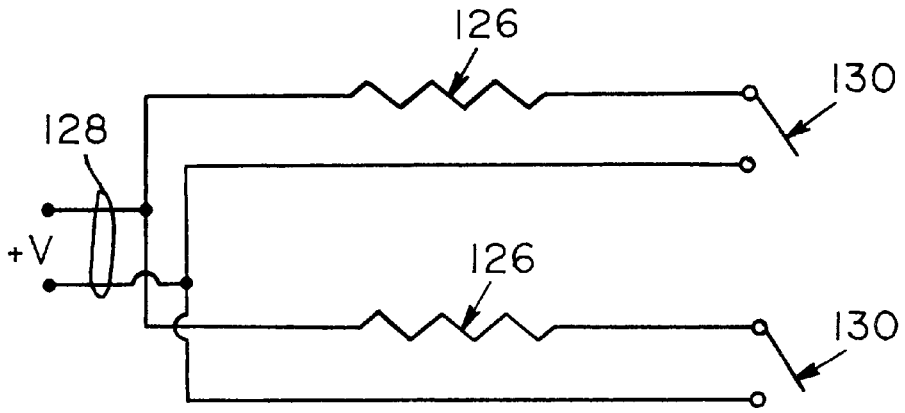
FIG. 6 is a circuit diagram of the electrical portions of the coffee system of FIG. 4.

One embodiment of a coffee system 100 in accordance with the invention is shown in FIGS. 4–6. Referring to FIGS. 4 and 5, the coffee system 100 may include one or more coffee pots identical to the coffee pot 1 described above. The coffee system 100 may be provided with a coffee pot heating unit 110 and a coffee brewing system 120.

The coffee pot heating unit 110 may be provided with a base portion 121 having one or more heating areas, each of which may be in the form of a circular heating or warming plate 122. Each warming plate 122 may have a raised circular lip 124 disposed about its periphery so that a coffee pot having a circular bottom portion may be easily seated over the warming plate 122. A heating element 126, which may be provided in the form of a helical or ring-shaped coil, may be disposed directly below, in intimate contact with, each warming plate 122 so that heating of each heating element 126 will cause its associated warming plate 122 to be heated. The heating elements 126 may also be embedded in the warming plates 122.

Referring to FIG. 6, which is a circuit diagram of the electrical components of the heating unit 110, each of the heating elements 126 is embodied as a resistive heating element and may be connected to a voltage source, such as 120 volts, that may be provided via a conventional AC outlet, via a power cord 128. Each of the heating elements 126 may have an on-off switch 130 associated therewith to selectively interrupt the flow of electric current through the heating elements 126.

When coffee pots such as the coffee pot 1 described above are used, it has been discovered that the use of a member, such as the pivot member 38, to prevent the escape of vapors also reduces the amount of heat dissipation from the coffee contained within the coffee pot 1. Consequently, it has been discovered that the power output of the heating coils 126 may be reduced, thus saving electrical power and the cost associated therewith, while still maintaining the coffee within the coffee pot 1 at the desired temperature.

Accordingly, each of the heating elements 126 may generate an electrical power output of no greater than about 80 watts when connected to an electrical power source of about 120 volts. As is known, the relationship between the power output of a heating element, its resistance and the voltage applied across the heating element is as follows:

$$\text{Resistance}=(\text{Voltage})^2/\text{Desired Power Output}$$

Where "Resistance" is the resistance of the heating element, where "Voltage" is the voltage supplied by the power source, and where "Desired Power Output" is the desired power output of the heating element in watts.

In order to generate a power output of no greater than about 80 watts for a power source that generates 120 volts, the resistance of each of the heating elements 126 should be no less than about $(120)^2/80$, or about 180 ohms. Each of the heating elements 126 may be designed to generate a power output of no greater than about 50 watts for a power source that generates 120 volts. In that case, the resistance of each of the heating elements 126 should be no less than about $(120)^2/50$, or about 290 ohms.

Each of the heating elements 126 may be provided with a somewhat different resistance to accommodate, for example, expected fluctuations in voltage typically generated by conventional 120-volt power outlets. Also, in some cases it might be desirable to incorporate a potentiometer in series with the heating elements 126 to allow a user to adjust the power output. In that case, the resistance (if any) of the potentiometer may be taken into account in determining the appropriate resistance value of the heating elements.

The brewing system 120 may be any type of conventional brewing system. For example, referring to FIGS. 4 and 5, the brewing system 120 may include a hot water heater (not shown), a hot water tank (not shown), a pair of coffee filter holders 140 that are adapted to slide into a pair of holding slots 142 formed in the brewing system 120. During operation of the brewing system, hot water may be discharged or pumped from the hot water tank and into one of the coffee filter holders 140 so that the hot water passes through a coffee filter 144 having coffee disposed therein and through a coffee discharge opening 146 disposed directly above the coffee pot 1 so that freshly brewed coffee flows into the coffee pot 1.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A coffee system, comprising:

a coffee pot comprising:

a coffee container for holding liquid coffee, said coffee container having an interior portion in which said liquid coffee may be contained;

a pouring spout associated with said coffee container; and a movable member associated with said coffee container, said movable member being movable between a closed position in which substantially no vapor may escape from said interior portion of said coffee container to the atmosphere and an open position in which liquid coffee can be poured into said coffee container from a location outside of said coffee container;

a coffee pot heating unit comprising:

a base;

a first circular heating area associated with said base, said first heating area having a size sufficient to accommodate a bottom portion of said coffee container, said first heating area having a circular lip with a raised elevation so as to retain said coffee container over said first heating area;

a first heating element associated with said first heating area to heat said first heating area, said first heating element having an electrical resistance such that said first heating element generates no greater than about 80 watts of electrical power when said heating unit is connected to a 120-volt electrical power source; and a first switch associated with said first heating element that selectively interrupts current flow through said first heating element so as to allow said first heating element to be turned on and off;

a second circular heating area associated with said base, said second heating area having a size sufficient to accommodate a bottom portion of said coffee container, said second heating area having a circular lip with a raised elevation so as to retain said coffee container over said second heating area;

a second heating element associated with said second heating area to heat said second heating area, said second heating element having an electrical resistance such that said second heating element generates no greater than about 80 watts of electrical power when said heating unit is connected to a 120-volt electrical power source; and a second switch associated with said second heating element that selectively interrupts current flow through said second heating element so as to allow said second heating element to be turned on and off; and a coffee brewing system operatively associated with said coffee pot heating unit, said coffee brewing system having a coffee discharge opening through which freshly brewed coffee may pass, said coffee discharge opening being aligned with one of said heating areas so that, when said coffee pot is placed on said one heating area, freshly brewed coffee may pass through said coffee discharge opening and into said coffee pot.

2. A coffee system as defined in claim 1 wherein said movable member comprises a pivot member and wherein said coffee pot additionally comprises a support mechanism that pivotably supports said pivot member.

3. A coffee system as defined in claim 1 wherein said movable member comprises a pivot member having a center of gravity and wherein said pivot member is biased to said closed position by a support mechanism that pivotably supports said pivot member at a location on said pivot member offset from said center of gravity of said pivot member.

4. A coffee system as defined in claim 1 wherein each of said heating elements is disposed directly below one of said heating areas.

5. A coffee system as defined in claim 1 wherein each of said heating elements has an electrical resistance of no less than about 180 ohms.

6. A coffee system as defined in claim 1 wherein each of said heating elements has an electrical resistance such that each heating element generates no greater than about 50 watts of electrical power when each heating element is connected to a 120-volt electrical power source.

7. A coffee system as defined in claim 1 wherein each of said heating elements has an electrical resistance of no less than about 290 ohms.

8. A coffee system, comprising:

a coffee pot comprising:

a coffee container for holding liquid coffee, said coffee container having an interior portion in which said liquid coffee may be contained;

a pouring spout associated with said coffee container; and a movable member associated with said coffee container, said movable member being movable between a closed position in which substantially no vapor may escape from said interior portion of said coffee container to the atmosphere and an open position in which liquid coffee can be poured into said coffee container from a location outside of said coffee container; and a coffee pot heating unit comprising:

a base;

a circular heating area associated with said base, said heating area having a size sufficient to accommodate a bottom portion of said coffee container, said heating area having a circular lip with a raised elevation so as to retain said coffee container over said heating area;

a heating element associated with said heating area to heat said heating area, said heating element having an electrical resistance such that said heating element generates no greater than about 80 watts of electrical power when said heating unit is connected to a 120-volt electrical power source; and a switch associated with said heating element that selectively interrupts current flow through said heating element so as to allow said heating element to be turned on and off.

9. A coffee system as defined in claim 8 wherein said heating element is disposed directly below said heating area.

10. A coffee system as defined in claim 8 wherein said heating element has an electrical resistance of no less than about 180 ohms.

11. A coffee system as defined in claim 8 wherein said heating element has an electrical resistance such that said heating element generates no greater than about 50 watts of electrical power when said heating unit is connected to a 120-volt electrical power source.

12. A coffee system as defined in claim 8 wherein said heating element has an electrical resistance of no less than about 290 ohms.

13. A coffee system, comprising:

a coffee pot heating unit for heating a coffee pot having a coffee container, said coffee pot heating unit comprising:

a base;

a heating area associated with said base, said heating area having a size sufficient to accommodate a bottom portion of said coffee container; and a heating apparatus associated with said heating area to heat said heating area, said heating apparatus including a heating element and having an electrical resistance such that said heating apparatus generates no greater than about 80 watts of electrical power when said heating apparatus is connected to a 120-volt electrical power source, said heating apparatus generating a substantially fixed and constant electrical power output that does not change substantially while said heating apparatus is connected to said 120-volt power source; and a coffee pot disposed on said heating area of said coffee pot heating unit, said coffee pot comprising:

a coffee container for holding liquid coffee, said coffee container having an interior portion in which said liquid coffee may be contained, said coffee container being composed of glass; and a pouring spout associated with said coffee container.

14. A coffee system as defined in claim 13 additionally comprising a switch associated with said heating apparatus that selectively interrupts current flow through said heating apparatus so as to allow said heating apparatus to be turned on and off.

15. A coffee system as defined in claim 13 wherein said heating apparatus has an electrical resistance of no less than about 180 ohms.

16. A coffee system as defined in claim 13 wherein said heating apparatus has an electrical resistance such that said heating apparatus generates no greater than about 50 watts of electrical power when said heating apparatus is connected to a 120-volt electrical power source.

17. A coffee system as defined in claim 13 wherein said heating apparatus has an electrical resistance of no less than about 290 ohms.

18. A coffee pot heating unit, comprising:

a base;

a heating area associated with said base, said heating area having a size sufficient to accommodate a bottom portion of a coffee container; and a heating apparatus associated with said heating area to heat said heating area, said heating apparatus including a heating element and having an electrical resistance such that said heating apparatus generates no greater than about 80 watts of electrical power when said heating apparatus is connected to a 120-volt electrical power source, said heating apparatus generating a substantially fixed and constant electrical power output that does not change substantially while said heating apparatus is connected to said 120-volt power source.

19. A heating unit as defined in claim 18 additionally comprising a switch associated with said heating apparatus that selectively interrupts current flow through said heating apparatus so as to allow said heating apparatus to be turned on and off.

20. A heating unit as defined in claim 18 wherein said heating apparatus has an electrical resistance of no less than about 180 ohms.

21. A heating unit as defined in claim 18 wherein said heating apparatus has an electrical resistance such that said heating apparatus generates no greater than about 50 watts of electrical power when said heating apparatus is connected to a 120-volt electrical power source.

22. A heating unit as defined in claim 18 wherein said heating apparatus has an electrical resistance of no less than about 290 ohms.

23. A coffee pot heating unit, comprising:

a base;

a heating area associated with said base, said heating area having a size sufficient to accommodate a bottom portion of a coffee container having a coffee-holding capacity of a predetermined number of fluid ounces; and a heating apparatus associated with said heating area to heat said heating area, said heating apparatus including a heating element and having an electrical resistance such that said heating apparatus generates no greater than about 1.25 watts of electrical power for each fluid ounce of said coffee-holding capacity of said coffee container when said heating apparatus is connected to a 120-volt electrical power source, said heating apparatus generating a substantially fixed and constant power output that does not change substantially while said heating apparatus is connected to said 120-volt power source.

24. A heating unit as defined in claim 23 additionally comprising a switch associated with said heating apparatus that selectively interrupts current flow through said heating element so as to allow said heating apparatus to be turned on and off.

25. A heating unit as defined in claim 23 wherein said heating apparatus has an electrical resistance of no less than about 180 ohms.

26. A heating unit as defined in claim 23 wherein said heating apparatus has an electrical resistance such that said heating apparatus generates no greater than about one watt of electrical power for each fluid ounce of said coffee-holding capacity when said heating apparatus is connected to a 120-volt electrical power source.

27. A heating unit as defined in claim 23 wherein said heating apparatus has an electrical resistance of no less than about 290 ohms.

28. A coffee system, comprising:

a coffee pot comprising:

a coffee container for holding liquid coffee, said coffee container having an interior portion in which said liquid coffee may be contained;

a pouring spout associated with said coffee container; and a movable member associated with said coffee container, said movable member being movable between a closed position in which substantially no vapor may escape from said interior portion of said coffee container to the atmosphere and an open position in which liquid coffee can be poured into said coffee container from a location outside of said coffee container; and a coffee pot heating unit comprising:

a base;

a heating area associated with said base, said heating area having a size sufficient to accommodate a bottom portion of said coffee container; and a heating element associated with said heating area to heat said heating area, said heating element having an electrical resistance such that said heating element generates no greater than about 80 watts of electrical power when said heating unit is connected to a 120-volt electrical power source.

29. A coffee system as defined in claim 28 wherein said heating element is disposed directly below said heating area.

30. A coffee system as defined in claim 28 wherein said heating element has an electrical resistance of no less than about 180 ohms.

31. A coffee system as defined in claim 28 wherein said heating element has an electrical resistance such that said heating element generates no greater than about 50 watts of electrical power when said heating unit is connected to a 120-volt electrical power source.

32. A coffee system as defined in claim 28 wherein said heating element has an electrical resistance of no less than about 290 ohms.

33. A coffee heating apparatus, comprising:

a base;

a heating area associated with said base, said heating area having a size sufficient to accommodate a bottom portion of a coffee container; and a heating apparatus associated with said heating area to heat said heating area, said heating apparatus including a heating element and having an electrical resistance such that said heating apparatus generates no greater than about 80 watts of electrical power when said heating apparatus is connected to a 120-volt electrical power source.

34. A heating apparatus as defined in claim 33 additionally comprising a coffee pot comprising a coffee container having an interior portion in which said liquid coffee may be contained and a movable member associated with said coffee container, said movable member being movable between a closed position in which substantially no vapor may escape from said interior portion of said coffee container to the atmosphere and an open position in which liquid coffee can be poured into said coffee container from a location outside of said coffee container.

35. A heating apparatus as defined in claim 33 wherein said heating apparatus has an electrical resistance of no less than about 180 ohms.

36. A heating apparatus as defined in claim 33 wherein said heating apparatus has an electrical resistance such that said heating apparatus generates no greater than about 50 watts of electrical power when said heating apparatus is connected to a 120-volt electrical power source.

37. A heating apparatus as defined in claim 33 wherein said heating apparatus has an electrical resistance of no less than about 290 ohms.

38. A coffee heating apparatus, comprising:

a base;

a heating area associated with said base, said heating area having a size sufficient to accommodate a bottom portion of a coffee container having a coffee-holding capacity of a predetermined number of fluid ounces; and a heating apparatus associated with said heating area to heat said heating area, said heating apparatus including a heating element and having an electrical resistance such that said heating apparatus generates no greater than about 1.25 watts of electrical power for each fluid ounce of said coffee-holding capacity of said coffee container when said heating apparatus is connected to a 120-volt electrical power source.

39. A heating apparatus as defined in claim 38 additionally comprising a coffee pot comprising a coffee container having an interior portion in which said liquid coffee may be contained and a movable member associated with said coffee container, said movable member being movable between a closed position in which substantially no vapor may escape from said interior portion of said coffee container to the atmosphere and an open position in which liquid coffee can be poured into said coffee container from a location outside of said coffee container.

40. A heating apparatus as defined in claim 38 additionally comprising a switch associated with said heating apparatus that selectively interrupts current flow through said heating element so as to allow said heating apparatus to be turned on and off.

41. A heating apparatus as defined in claim 38 wherein said heating apparatus has an electrical resistance of no less than about 180 ohms.

42. A heating apparatus as defined in claim 38 wherein said heating apparatus has an electrical resistance such that said heating apparatus generates no greater than about one watt of electrical power for each fluid ounce of said coffee-holding capacity when said heating apparatus is connected to a 120-volt electrical power source.

43. A heating apparatus as defined in claim 38 wherein said heating apparatus has an electrical resistance of no less than about 290 ohms.

* * * * *